United States Patent [19]

Takahashi et al.

[11] 3,937,199

[45] Feb. 10, 1976

[54] FUEL INJECTION PUMP

[75] Inventors: Koichi Takahashi, Yokohama; Manabu Tsunematsu, Yokosuka, both of Japan

[73] Assignee: Nissan Motor Co., Ltd., Yokohama, Japan

[22] Filed: July 29, 1974

[21] Appl. No.: 492,910

[30] Foreign Application Priority Data

Aug. 20, 1973 Japan ..... 48-92405

[52] U.S. Cl...123/140 MC; 123/139 BD; 123/139 BG; 123/140 MP

[51] Int. Cl.[2] ..... F02D 1/04

[58] Field of Search.. 123/140 R, 140 MC, 140 MP, 123/139 BG, 139 BD

[56] References Cited

UNITED STATES PATENTS

| | | | |
|---|---|---|---|
| 3,107,483 | 10/1963 | Hamilton | 123/140 MC |
| 3,727,598 | 4/1973 | Knapp | 123/140 MC |
| 3,766,899 | 10/1973 | Isselhorst | 123/140 MC |
| 3,814,072 | 6/1974 | Gillespie | 123/140 MC |
| 3,820,517 | 6/1974 | Nambu | 123/140 MC |
| 3,826,234 | 7/1974 | Cinquegrani | 123/140 MC |

*Primary Examiner*—Charles J. Myhre
*Assistant Examiner*—Daniel J. O'Connor

[57] ABSTRACT

A fuel injection pump for an automotive fuel injection system, comprising a fuel metering unit which includes a plunger axially movable in synchronism with revolution of a pump shaft and rotatable about its axis for regulating timings and quantities of fuel injection, and a control device which consists largely of a centrifugal governor responsive to a centrifugal force developed by the revolution of the pump shaft for driving the plunger to turn about its axis through an angle proportional to the pump shaft revolution speed and a vacuum-operated actuator responsive to vacuum in an intake manifold of the engine for driving the plunger in accordance with the vacuum in the intake manifold.

6 Claims, 4 Drawing Figures

FUEL INJECTION PUMP

Figure 1A:
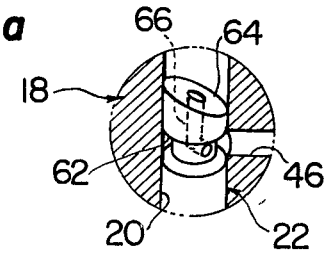

The present invention relates to fuel injection systems for automotive vehicles and, more particularly, to a fuel injection pump incorporated into the fuel injection system.

The fuel injection system for an automotive vehicle usually has incorporated therein a fuel injection pump of the Bosch type having a plunger which is not only axially movable in synchronism with the revolution of a pump shaft but rotatable about its axis for controlling the timings and durations of the fuel injection. The rotational position of the plunger is controlled in accordance with load requirements of the engine by means of a control device responsive to the engine load requirements. A variety of modifications of such a control device have thus far been proposed and placed on use. None of the control devices of the known constructions are, however, fully acceptable especially because of the problems encountered by means to drive a control rod or rack which is used to impart rotational forces to the plunger. It is, accordingly, an important object of the present invention to provide a fuel injection pump having an improved control device. Another important object of the invention is to provide a fuel injection pump having a control device which is capable of accurately and reliably controlling the timings and quantities of the discharge of fuel in accordance with the load requirements of the engine. Still another important object of the invention is to provide a fuel injection pump having a control device which is capable of smoothly driving a control rod for a plunger of a fuel metering unit of the pump.

In accordance with the present invention, these objects will be accomplished in a fuel injection pump which comprises a pump shaft rotatable about its axis, a fuel metering unit having a plunger which is driven to axially reciprocally move in cycles synchronized with the revolution of the pump shaft for discharging fuel in each of the cycles and which is rotatable about its axis for regulating timings, durations and quantities of the discharge of the fuel from the fuel metering unit in the cycles, an elongated control member which is in driving engagement with the plunger and which is axially movable in both directions for driving the plunger to rotate in either direction about its axis, resilient biasing means supported on the elongated control member for biasing the control member in one of the directions, a centrifugal governor responsive to a centrifugal force developed by the revolution of the pump shaft, linkage means engaging the elongated control member and the centrifugal governor for axially moving the control member in the other of the directions against a force of the resilient biasing means, and a vacuum-operated actuator responsive to vacuum in an air intake unit of the engine for bodily moving an assembly of the elongated control member, the resilient biasing means, the centrifugal governor and the linkage means in a direction parallel to the directions of axial movement of the elongated control member in accordance with the vacuum directed from the air intake unit into the vacuum-operated actuator. The centrifugal governor may comprise a flyweight carrier rotatable with and axially movable with a rotary shaft driven by the pump shaft, at least one flyweight pivotally mounted on the weight carrier for being turned away from the rotary shaft in response to a centrifugal force produced by the revolution of the rotary shaft, and at least one pressure arm integral with the flyweight and accordingly pivotally movable on the flyweight carrier for driving the linkage means to drive the elongated control member in said other of the directions of axial movement when the flyweight is turned away from the rotary shaft in response to the centrifugal force developed by the revolution of the rotary shaft. The linkage means may comprise a sliding block axially movable on the rotary shaft and engaging the pressure arm of the centrifugal governor for being axially moved in one direction on the rotary shaft when the pressure arm is moved by the turning of the flyweight of the centrifugal governor away from the rotary shaft and a link lever pivotally connected at one end to the sliding block and at the other to the elongated control member. The resilient biasing means may comprise at least one preload spring seated at one end on a first seat member which is fast on the elongated control member and at the other end on a second seat member which is movable relative to the control member in directions aligned with an axis of the control member and which is movable with the centrifugal governor in directions parallel to the axis of the elongated control member. The fuel injection pump may further comprise a stationary shaft which extends in parallel to the elongated control member and the rotary shaft connected to the pump shaft and a sleeve axially movable on the stationary shaft and to which the link lever is pivotally connected at its intermediate portion.

Figure 1:
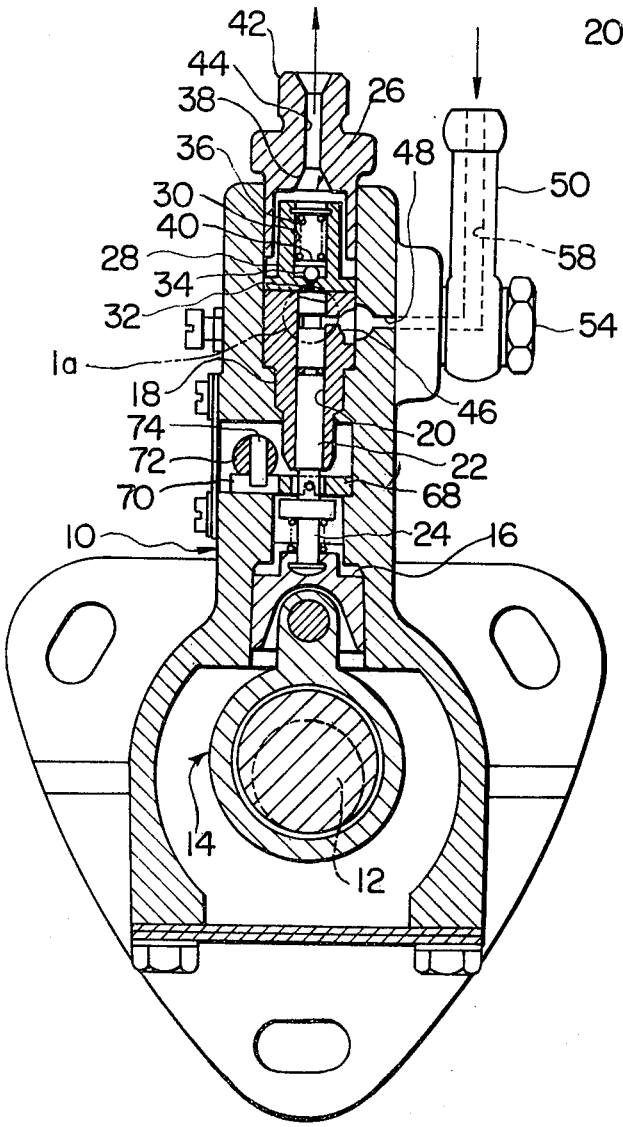
Figure 2:
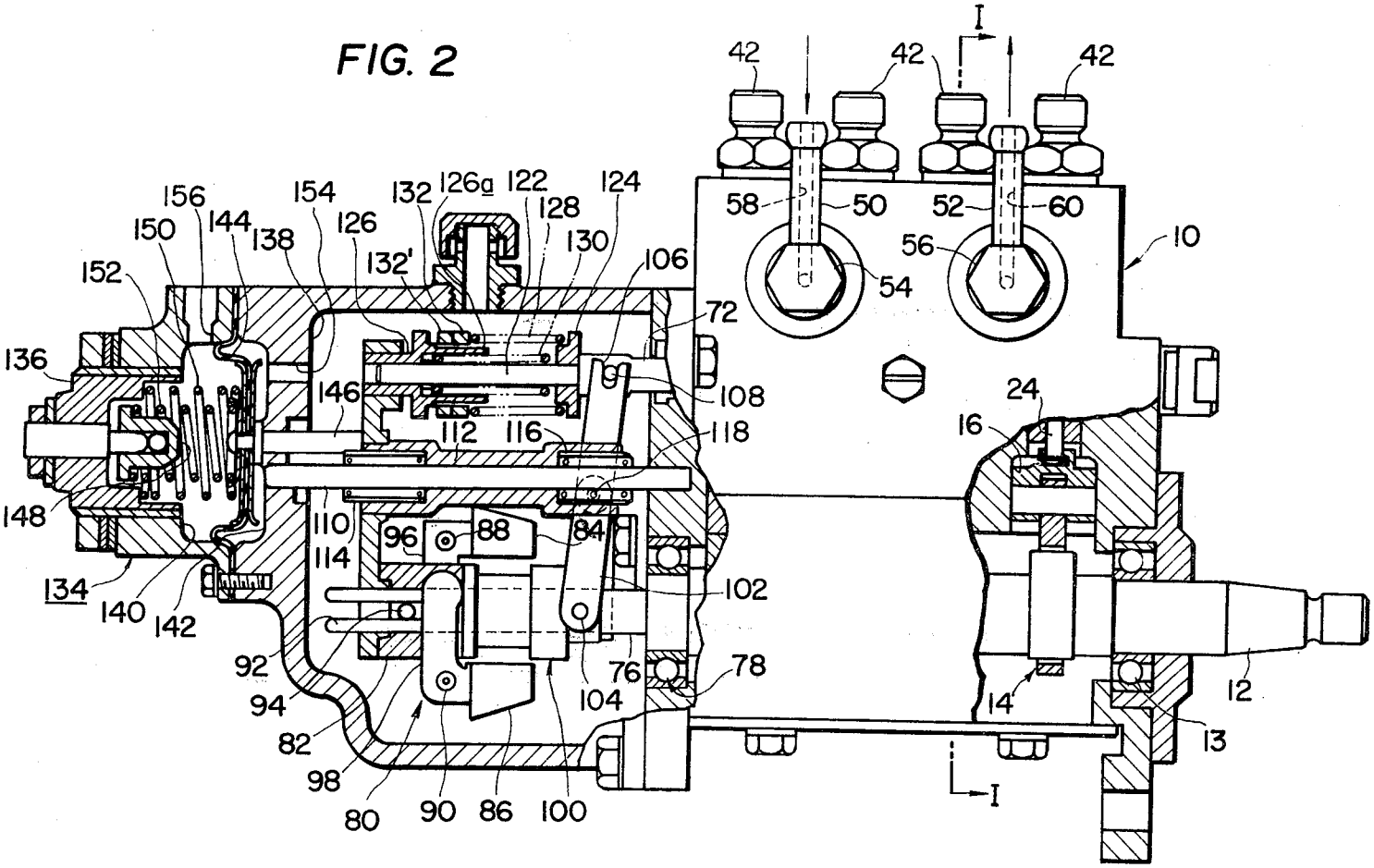
Figure 3:
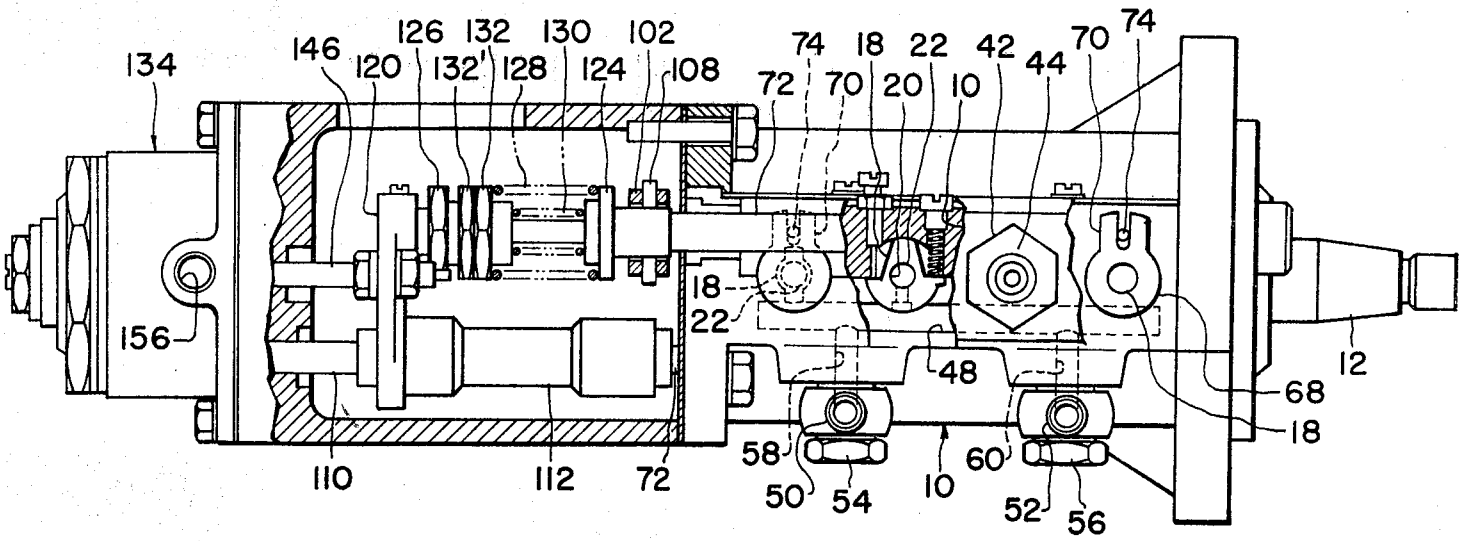

The features and advantages of the fuel injection pump according to the present invention will become more apparent from the following description taken in conjunction with the accompanying drawings in which:

FIG. 1 is a vertical sectional view which shows an arrangement of fuel metering units of the fuel injection pump according to the present invention;

FIG. 1*a* is a perspective view which shows, on an enlarged scale, a portion 1*a* of the arrangement illustrated in FIG. 1;

FIG. 2 is a side elevational view of the fuel injection pump according to the present invention, the view being partly cut away to show details of a control device incorporated into the fuel injection pump; and FIG. 3 is a top end view, also partly cut away, of the fuel injection pump according to the present invention.

Referring to the drawings, particularly to FIGS. 1, 2 and 3, the fuel injection pump of the type which is developed from original Bosch designs comprises a pump housing 10 which is formed with axial bores respectively incorporating therein fuel metering units which correspond in number to the number of cylinders of the engine which the fuel injection pump is to suit. A pump shaft 12 extends into the housing 10 at right angles to axes of the bores incorporating the individual fuel metering units and is rotatably supported on the pump housing 10 through a bearing 13 (FIG. 2). The pump shaft 12 is connected to the crankshaft of the engine (not shown) through an endless belting (not shown) or other suitable transmission means and is driven to rotate about its axis when the engine is operative. The pump shaft 12 is operatively connected through a cam or swash-plate mechanism 14 to a guide piston 16 axially slidably received in an axial end portion of each of the bores in the pump housing, as best seen in FIG. 1. The guide piston 16 is thus adapted to be axially moved back and forth in the bore in the housing 10 when the pump shaft 12 is driven by the engine crankshaft. In an axially intermediate portion of each of the bores in the pump housing 10 is closely received a barrel 18 which has an axial bore 20 extending throughout the length of the barrel. A reciprocating and rotary plunger 22 is received in the bore 20 in the barrel 18 and is connected at one end (shown as a lower end in FIG. 1) to a tappet 24 which is fixed at its leading end to the guide piston 16. Each of the bores in the pump housing 10 has further received in its axial end portion remote from the guide piston 16 a fuel delivery valve 26 which comprises a valve casing 28 fixed to the pump housing 10 and formed with an axial bore 30 communicating at one end (which is shown as a lower end in FIG. 1) to the bore 20 in the barrel 18 through an aperture 32 formed in the casing 28 and open at the other end. In the axial bore 30 of the valve casing 28 are positioned a ball member 34 which is located in the vicinity of the aperture 32 in the valve casing 28, a preload spring 36 for biasing the ball member 34 into a position closing the aperture 32, and spring seat members 38 and 40 on which the preload spring 36 is seated at its ends. A cap member 42 is received at the axial end of each of the bores in the pump housing 10, having an axial bore 44 which is in constant communication with the bore 30 in the valve casing 28 and which leads to a fuel injection nozzle (not shown) which projects into the associated engine cylinder combustion chamber or intake manifold. The construction of the fuel delivery valve 26 above described is merely by way of example and may therefore be modified in numerous manners.

The barrel 18 in each of the fuel metering units is formed with a fuel inlet port 46 which is open to the bore 20 in the barrel. The fuel inlet ports 46 thus formed in the barrels 18 of the individual fuel metering units are in communication with a common passageway 48 which is formed in the pump housing 10, the passageway extending at right angles to the axial bores in the housing 10 as will be understood from FIG. 3. A pair of nipples 50 and 52 are secured to the pump housing 10 by bolts 54 and 56, respectively. One nipple 50 has a fuel feed passageway 58 leading from a source (not shown) of a fuel for the engine and opens into the passageway 48 in the pump housing 10, whereas the other nipple 52 has a fuel return passageway 60 which is in communication at one end with the passageway 48 in the pump housing 10 and at the other end with a fuel reservoir (not shown).

As shown on an enlarged scale in FIG. 1*a*, the plunger 22 of each of the fuel metering units has a top portion formed with a circumferential groove 62 and having a ramped top face 64 which has an elliptical edge. In the top portion of the plunger 22 is formed a channel 66 which is open at one end into an axial end portion of the bore 20 in the barrel 18 and at the other end into the circumferential groove 62 in the plunger 22, thereby providing constant communication between the aperture 32 in the valve casing 28 and the circumferential groove 62 in the plunger 22. Communication will thus be provided between the aperture 32 in the valve casing 28 and the fuel inlet port 46 in the barrel 18 through the channel 66 in the top portion of the plunger 22 when the circumferential groove 62 in the plunger 22 is brought into alignment with the fuel inlet port 46 in the barrel 18.

When, in operation, the engine is operated and accordingly the pump shaft 12 is driven to rotate about its axis, the plunger 22 is driven to axially move back and forth in the axial bore 20 in the barrel 18. As the plunger 22 thus ascends or is moved toward the valve casing 28, the top portion of the plunger 22 having the ramped top face 64 covers and closes the fuel inlet port 46 in the barrel 18 so that the fuel in the passageway 48 in the pump housing 10 is not passed over to the fuel delivery valve 26. The timing at which the fuel inlet port 46 is closed and the duration for which the fuel inlet port 46 is kept closed by the plunger 22 are dictated by the relative position of the ramped top face of the plunger 22 to the fuel inlet port 46 or, in other words, the relative rotational position of the plunger 22 to the barrel 18. When the fuel inlet port 46 in the barrel 18 is thus closed by the top end portion of the plunger 22, the fuel which has entered the bore 20 between the ramped top face 64 of the plunger 22 and the bottom end of the valve casing 28 is compressed by the plunger 22 which is being axially moved toward the valve casing 28 by means of the guide piston 16, causing the ball member 34 of the fuel delivery valve 26 to be unseated from the valve seat on the bottom wall of the valve casing 28 against the opposing force of the preload spring 36 and thereby holding open the aperture 32 in the valve casing 28. The fuel staying a top the ramped top face 64 of the plunger 22 is therefore admitted into the bore 30 in the valve casing 28 and from the bore 30 into the engine combustion chamber or intake manifold through the axial bore 44 in the cab member 42. When the plunger 22 is further moved toward the valve casing 28 and accordingly the circumferential groove 22 in the top portion of the plunger 22 is brought into alignment with the fuel inlet port 46 in the barrel 18, the fuel inlet port 46 is uncovered by the top portion of the plunger 22 and is accordingly allowed to communicate with the top end portion of the axial bore 20 in the barrel 18 adjacent the aperture 32 in the bottom wall of the valve casing 28 through the channel 66 in the top end portion of the plunger 22. The fuel remaining between the ramped top face 64 of the plunger 22 and the bottom wall of the valve casing 28 is therefore permitted to return to the fuel inlet port 46 in the barrel 18 through the channel 66 in the top end portion of the plunger 22 and is directed from the fuel inlet port 46 to the fuel reservoir (not shown) through the passageway 48 in the pump housing 10 and the fuel return passageway 60 in the nipple 52. The fluid pressure acting on the ball member 34 of the fuel delivery valve 26 is consequently reduced so that the ball member 34 is allowed to move back to the initial position closing the aperture 32 in the valve casing 28 whereby the discharge, in one cycle, of the fuel from the fuel delivery valve 26 terminates. When the plunger 22 is caused to descend from the raised axial position, the fuel inlet port 46 in the barrel 18 is for a second time covered and closed by the top end portion of the plunger 22 until the edge of the ramped top face 64 of the plunger 22 reaches the fuel inlet port 46. When the ramped top face 64 of the plunger 22 overrides the fuel inlet port 46, then the fuel inlet port 46 is uncovered by the plunger 22 so that the fuel supplied from the fuel source (not shown) is admitted into the bore 20 in the barrel 18 through the fuel feed passageway 58 in the nipple 50 and the passageway 48 in the pump housing 10.

Each of the fuel metering units of the fuel injection pump is thus operative to discharge the fuel at timings and in quantities which are dictated by the relative position of the ramped top face 64 of the plunger 22 to the fuel inlet port 46 in the barrel 18. The relative position of the ramped top face 64 of the plunger 22 is, in turn, determined by the rotational position of the plunger 22 about its axis. The timings and durations of the discharge of the fuel and accordingly the quantities of the fuel discharged from each of the fuel metering units in the successive cycles of fuel injection can therefore be controlled by turning plunger 22 about its axis depending upon varying engine load. A rotary disc member 68 having a generally U-shaped or recessed arm 70 is therefore rotatable with the plunger 22 about the axis of the plunger in each of the fuel metering units. The rotary disc members 68 thus mounted on the plungers 22 of the individual fuel metering units are driven by a common plunger control rod 72 which fixedly carries thereon pins 74 which are respectively slidably received in the U-shaped or recessed arms 70. When the plunger control rod 72 is axially or longitudinally moved in either direction relative to the fuel metering units, the rotary disc members 68 of the individual fuel metering units are rotated about the respective axes of the plungers 22 of the metering units so that the plungers 22 are rotated about their respective axes in a direction corresponding to the direction of movement of the control rod 72 and through angles which correspond to the distance over which the control rod 72 is moved. Where desired, the plunger driving arrangement thus including the rotary disc members 68 and the control rod 72 may be replaced with a combination of pinions which are respectively rotatable with the plungers of the individual fuel metering units and a rack which is in constant mesh with the pinions, though not shown in the drawings.

In accordance with the present invention, the plunger control rod 72 or the rack above-mentioned is driven by a control device which is responsive to the revolution speed of the pump shaft 12 and the vacuum which is developed in the intake manifold of the engine during operation. The control device comprises a rotary shaft 76 which is rotatable about its axis in a bearing 78 supported on a wall portion of the pump housing 10 and which is connected at one end to the pump shaft 12, as seen in FIG. 2. A mechanical or centrifugal governor generally designated by reference numeral 80 comprises a flyweight carrier 82 mounted on the rotary shaft 76 and a pair of flyweights 84 and 86 which are pivotally supported on the flyweight carrier 82 through pivotal pins 88 and 90, respectively. The rotary shaft 76 has a generally fork-shaped end portion which is formed with an elongated axial recess 92 and the flyweight carrier 82 of the centrifugal governor 80 has a pin 94 which is received in this elongated axial recess 92 in the rotary shaft 76 so that the flyweight carrier 82 and accordingly the flyweights 84 and 86 are rotatable with and axially movable on the rotary shaft 76. The flyweights 84 and 86 are shown as being in diametrically opposed relation to each other across an axis of the rotary shaft 76.

The centrifugal governor 80 further comprises pressure arms 96 and 98 which are integral with the flyweights 84 and 86, respectively and which have substantially rounded working portions at their leading ends. The pressure arms 96 and 98 are thus rotatable about the pivotal pins 88 and 90 when the flyweights 84 and 86 are rotated about the pins 88 and 90, respectively. The rotary shaft 76 further carriers thereon a sliding block 100 which is axially slidable on the rotary shaft 76 and which is engageable at one of its end faces with the rounded working portions of the pressure arms 96 and 98 of the centrifugal governor 80. A link lever 102 is pivotally connected at one end to the sliding block 100 by means of a pivotal pin 104 and is formed with a recess 106 in the other end portion thereof. The control rod 72 to drive the plungers 22 of the individual fuel metering units extends in parallel to the rotary shaft 76 and has a pin 108 which is received in the recess 106 in the link lever 102. A guide shaft 110 is fixedly supported on the pump housing 10 and extends in parallel to the control rod 72 and the rotary shaft 76. A sleeve 112 is axially slidably supported on this guide shaft 110 through bearings 114 and 116. The link lever 102 is pivotally connected at its intermediate portion to this sleeve 112 through a pivotal pin 118. The sleeve 112 is fixedly connected to the flyweight carrier 82 of the centrifugal governor 80 through a connecting member 120 and are thus movable together in directions parallel to the rotary shaft 76 and the guide shaft 110.

The control rod 72 has an axial extension 122 which has fixedly carries a first spring seat member 124 at its end adjacent to the leading end of the control rod 72 and is axially slidably received at its opposite end in a second spring seat member 126 which is fixed to the previously mentioned connecting member 120 interconnecting the sleeve 112 on the guide shaft 110 and the flyweight carrier 82 of the centrifugal governor 80. Preload springs 128 and 130 are thus seated between the first and second spring seat members 124 and 126, urging the second spring seat member 126 away from the first spring member 124. To provide ease of adjusting the preload of the springs 128, the second spring seat member 126 may have an externally threaded portion **126*a* which is engaged by internally threaded ring members 132 and 132' so that the spring 128 is seated at one end on the ring member 132**, as shown.

The control device for the control rod 72 further comprises a vacuum-operated actuator which is generally designated by reference numeral 134 in FIGS. 2 and 3. The vacuum-operated actuator 134 has a chamber defined between spaced portions 136 and 138 of the pump housing 10. The chamber is divided into vacuum and atmospheric compartments 140 and 142 by a diaphragm 144 which is anchored at its entire perimeter to the pump housing 10 as shown in FIG. 2. The diaphragm 144 is connected to the connecting member 120 by a connecting rod 146 which extends across the atmospheric compartment 142 and which is axially movably inserted through the wall portion 138 of the pump housing 10. In the vacuum compartment 140 are positioned a spring seat member 148 which is supported on the wall portion 136 of the pump housing 10 and preload springs 150 and 152 one of which is seated between the diaphragm 144 and the wall portion 136 of the pump housing 10 and the other of which is seated between the diaphragm 144 and the spring seat member 148. The preload springs 150 and 152 are thus adapted to urge the diaphragm 144 toward the wall portion 138 of the pump housing 10, viz., into the position in which the connecting rod 146 is withdrawn from the atmospheric compartment 142. The atmospheric compartment 142 is vented to the open air through, for example, an opening 154 formed in the wall portion 138 of the pump housing 10 and is thus maintained at an atmospheric pressure, whereas the vacuum compartment 140 is in constant communication with the intake manifold (not shown) of the engine through a port 156 formed in the wall portion 136 of the pump housing 10 so that the vacuum developed in the intake manifold of the engine is directed into the vacuum compartment 140 during operation of the engine.

When, in operation, the pump shaft 12 is driven from the crankshaft of the engine, the plungers 22 of the individual fuel metering units of the pump are axially moved in the associated barrels 18 so that the fuel is discharged from the fuel delivery valves 26 of the metering units into the associated combustion chambers of the engine at timings and in quantities which are dictated by the rotational positions of the plungers 22 about their axes, viz., the relative positions of the ramps at the upper ends of the plungers 22, as previously described. When the plungers 22 are thus driven to axially move in the individual fuel metering units, the centrifugal governor 80 is also driven to rotate about the axis of the rotary shaft 76 so that the flyweights 84 and 86 are caused to turn or raise away from the rotary shaft 76 about the pivotal pins 88 and 90, respectively, under the influence of the centrifugal force imparted thereto. The pressure arms 96 and 98 integral with the flyweights 84 and 86, respectively, are thus caused to turn about the pivotal pins 88 and 90 in directions to move the sliding block 100 away from the flyweight carrier 82 of the centrifugal governor 80. The link lever 102 is consequently turned counterclockwise of the drawing (FIG. 2) about the pin 118 on the sleeve 112 on the guide shaft 110 so that the control rod 72 is axially moved leftwardly of the drawing against the opposing forces of the springs 128 and 130 seated between the spring seat members 124 and 126. The control rod 72 is thus moved smoothly and in a stable condition because the driving force imparted thereto from the centrifugal governor 80 is at all times acted upon by the forces of the preload springs 128 and 130. As the control rod 72 is thus moved leftwardly of the drawing (FIG. 2), the extension 122 of the control rod 72 is axially moved deeper into the spring seat member 126 at its leading end. The axial movement of the extension 122 of the control rod 72 relative to the spring seat member 126 and accordingly to the connecting member 120 is stopped by the spring seat member 126 when the revolution speed of the pump shaft 12 peaks up. The control rod 72 is, in this manner, axially moved over a distance which is substantially proportional to the revolution speed of the pump shaft 12 so that the plungers 22 of the individual fuel metering units are rotated about their respective axes through angles which are related to the revolution speed of the pump shaft 12. The timings and quantities of the fuel discharged from the fuel delivery valves 26 of the fuel metering units are controlled responsive to the revolution speed of the pump shaft 12.

When the revolution speed of the pump shaft 12 then decreases, the flyweights 84 and 86 are radially moved toward the rotary shaft 76 about the pivotal pins 88 and 90, respectively, so that the sliding block 100 is allowed to move toward the flyweight carrier 82 of the centrifugal governor 80 and accordingly the link lever 102 allowed to rotate clockwise of the drawing (FIG. 2) about the pivotal pin 118 on the sleeve 112 on the guide shaft 110. The control rod 72 is therefore moved rightwardly of the drawing or away from the spring seat member 126 on the connecting member 120 so that the plungers 22 of the fuel metering units are turned in reverse directions about their respective axes.

When, on the other hand, a vacuum is developed in the intake manifold of the engine as during part-throttle condition of the engine, the vacuum is directed into the vacuum compartment 140 of the vacuum-operated actuator 134 through the port 156. The diaphragm 144 is consequently moved toward the wall portion 136 of the pump housing 10, viz., toward a position to contract the vacuum compartment 140 against the opposing forces of the preload springs 150 and 152. This causes the connecting rod 146 to project into the atmospheric compartment 142 so that the connecting member 120 is moved toward the intermediate wall portion 138 of the pump housing 10. The connecting member 120, the centrifugal governor 80 having the flyweight carrier 82 secured to the connecting member 110, the sliding block 100 engaged by the pressure arms 96 and 98 of the centrifugal governor 80, the sleeve 112 on the guide shaft 110, and the spring seat member 126 secured to the connecting member 120 are thus bodily moved toward the intermediate wall portion 138 of the pump housing 10 so that the control rod 72 is axially moved leftwardly of the drawing (FIG. 2) with the position of the link lever 102 maintained relative to the sliding block 100, the sleeve 112, and the control rod 72. The connecting member 120 and the parts secured thereto will be held stationary when the force of the vacuum directed into the vacuum compartment 140 is equalized with the opposing forces of the preload springs 150 and 152. When the vacuum in the intake manifold is then reduced, the diaphragm 144 is moved back away from the end wall portion 136 of the pump housing 10 by the forces of the preload springs 150 and 152 so that the connecting member 120 is moved away from the intermediate wall portion 138 of the pump housing 10. The centrifugal governor 80, the sliding block 100 and the spring seat member 126 are consequently moved in an integral unit away from the intermediate wall portion 138 of the pump housing 10 so that the control rod 72 is moved rightwardly of the drawing (FIG. 2) with the position of the link lever 102 maintained relative to the sliding block 100, the sleeve 112 and the control rod 72. The control rod 72 and accordingly the plungers 22 of the fuel metering units are in this manner driven by the vacuum-operated actuator 34 so that the timings and quantities of the fuel discharged from the fuel delivery valves 26 of the metering units are controlled in accordance with not only the revolution speed of the pump shaft 12 but the vacuum in the intake manifold of the engine.

What is claimed is:

1. A fuel injection pump of a fuel injection system of an automotive vehicle, comprising a pump shaft rotatable about its axis, a fuel metering unit having a plunger which is axially reciprocally movable in cycles synchronized with the revolution of the pump shaft for discharging fuel in each of the cycles and which is rotatable about its axis for regulating timings, durations and quantities of the discharge of the fuel in said cycles, an elongated control member which is in driving engagement with the plunger and which is axially movable in both directions for driving the plunger to rotate in either direction about its axis, resilient biasing means supported on the elongated control member for biasing the control member in one of said directions, a centrifugal governor responsive to a centrifugal force developed by the revolution of the pump shaft, linkage means engaging the elongated control member and the centrifugal governor for axially moving the elongated control member in the other of said directions against a force of said resilient biasing means, and a vacuum-operated actuator responsive to vacuum in an air intake unit of the engine for bodily moving a one-piece assembly comprising the elongated control member, the resilient biasing means, the centrifugal governor and the linkage means in a direction parallel to the directions of axial movement of the elongated control member in accordance with the vacuum directed from the air intake unit to the vacuum-operated actuator.

2. A fuel injection pump as set forth in claim 1, in which said centrifugal governor comprises a flyweight carrier rotatable with and axially movable on a rotary shaft driven by the pump shaft and extending in parallel with said elongated control member, at least one flyweight pivotally mounted on the flyweight carrier for being turned away from the rotary shaft in response to a centrifugal force produced by the revolution of the rotary shaft, and at least one pressure arm integral with the flyweight and accordingly pivotally movable on the flyweight carrier for driving said linkage means to drive the elongated control member in said other of the directions of axial movement of the control member when the flyweight is turned away from the rotary shaft in response to said centrifugal force.

3. A fuel injection pump as set forth in claim 2, in which said linkage means comprise a sliding block axially movable on said rotatry shaft and engaging said pressure arm of the centrifugal governor for being axially moved in one direction on the rotary shaft when the pressure arm is moved by the turning of the flyweight away from the rotary shaft, and a link lever which is pivotally connected at one end to said sliding block and at the other end to the elongated control member.

4. A fuel injection pump as set forth in claim 1, in which said resilient biasing means comprise at least one preload spring which is seated at one end on a first seat member fast on the elongated control member and at the other end on a second seat member which is movable relative to the control member in directions aligned with an axis of the control member and which is movable with the centrifugal governor in directions parallel to the axis of the elongated control member.

5. A fuel injection pump as set forth in claim 3, further comprising a stationary shaft which extends in parallel to said elongated control member and said rotary shaft and a sleeve axially slidable on the stationary shaft, wherein said link lever is pivotally connected to the sleeve at its intermediate portion.

6. A fuel injection pump as set forth in claim 5, in which said vacuum-operated actuator comprises a chamber structure formed with a chamber therein, a diaphragm dividing the chamber into an atmospheric compartment vented from the open air and a vacuum compartment which is in constant communication with the air intake unit of the engine so that the vacuum in the air intake unit is directed into the vacuum compartment and acts on said diaphragm, means to connect the diaphragm to said centrifugal governor, the second seat member and the sleeve, and resilient biasing means biasing the diaphragm to move against the vacuum acting on the diaphragm.

* * * * *